US009921035B2

(12) United States Patent
Jandl et al.

(10) Patent No.: US 9,921,035 B2
(45) Date of Patent: Mar. 20, 2018

(54) MORTAR TRAINING DEVICE

(71) Applicants: Martin Jandl, Slavkov u Brna (CZ); Kai Schlegel, Herbligen (CH)

(72) Inventors: Martin Jandl, Slavkov u Brna (CZ); Kai Schlegel, Herbligen (CH)

(73) Assignees: Saab Bofors Dynamics Switzerland Ltd., Thun (CH); Saab Trainings & Simulation, Slavkov U Brna (CZ)

( * ) Notice: Subject to any disclaimer, the term of this patent is extended or adjusted under 35 U.S.C. 154(b) by 217 days.

(21) Appl. No.: 14/828,410

(22) Filed: Aug. 17, 2015

(65) Prior Publication Data

US 2016/0238344 A1 Aug. 18, 2016

(30) Foreign Application Priority Data

Feb. 12, 2015 (DE) ..... 20 2015 001 085 U

(51) Int. Cl.

| | |
|---|---|
| ***F41A 33/00*** | (2006.01) |
| ***F41G 3/26*** | (2006.01) |
| ***F42B 8/20*** | (2006.01) |
| ***F41F 1/06*** | (2006.01) |

(52) U.S. Cl.

CPC ..... *F41G 3/26* (2013.01); *F41A 33/00* (2013.01); *F41F 1/06* (2013.01); *F42B 8/20* (2013.01)

(58) Field of Classification Search

USPC ..... 434/11, 12, 16, 17, 19, 24; 102/445

See application file for complete search history.

(56) References Cited

U.S. PATENT DOCUMENTS

| | | | | |
|---|---|---|---|---|
| 2,801,586 | A * | 8/1957 | Mongello | F41A 33/00 102/372 |
| 2,809,624 | A * | 10/1957 | Becher | F41A 33/00 124/77 |
| 4,427,386 | A * | 1/1984 | Fields | F41G 3/26 434/19 |
| 4,711,180 | A * | 12/1987 | Smolnik | F42B 8/10 102/372 |
| 5,228,855 | A * | 7/1993 | Frost | F42B 8/20 102/373 |
| 6,059,573 | A | 5/2000 | Patel | |
| 6,085,629 | A * | 7/2000 | Thiesen | F41G 3/04 89/41.03 |
| 6,193,517 | B1 * | 2/2001 | Lazecki | F41A 33/00 434/12 |

(Continued)

FOREIGN PATENT DOCUMENTS

| | | | |
|---|---|---|---|
| EP | 0952422 | A1 | 10/1999 |
| WO | 2013/025103 | A1 | 2/2013 |

*Primary Examiner* — Kurt Fernstrom

(74) *Attorney, Agent, or Firm* — Rankin, Hill & Clark LLP

(57) ABSTRACT

A training device for a mortar that includes a firing tube with a front, open end, a rear end, a tube wall and a removal opening for removing a round of mortar training ammunition from the firing tube. The training device further includes a base plate to which the rear end of the firing tube is pivotably connected and a support with an aiming and alignment device. The firing tube is movably connected to the support on a front area by the aiming and alignment device. The training device also includes a transport device arranged on the rear and of the firing tube with which rounds of mortar training ammunition can be automatically transported away out of the firing tube through the removal opening.

26 Claims, 7 Drawing Sheets

(56) References Cited

U.S. PATENT DOCUMENTS

| | | | | |
|---|---|---|---|---|
| 7,421,934 | B1 * | 9/2008 | Madulka | F41A 33/00 102/445 |
| 8,459,996 | B2 * | 6/2013 | Sullivan | F41G 3/265 42/114 |
| 2008/0053302 | A1 * | 3/2008 | Persson | F41G 3/165 89/41.01 |
| 2009/0053678 | A1 * | 2/2009 | Falkenhayn | F41A 33/00 434/16 |
| 2014/0038136 | A1 * | 2/2014 | Hamilton | F41G 3/26 434/19 |
| 2016/0169626 | A1 * | 6/2016 | Christians | F41A 33/00 434/11 |

* cited by examiner

MORTAR TRAINING DEVICE

BACKGROUND OF INVENTION

Field of Invention

The invention relates to a training device for a mortar and to mortar training ammunition for use with such a training device for a mortar.

Brief Description of Related Art

Known simulators for a training the operation of military weapons frequently have the disadvantage that the simulation does not correspond to reality in decisive actions. In particular in the case of training devices for a mortar where the mortar training ammunition is not fired and must frequently be removed by hand through a removal opening from the firing tube, this can cause false manipulations in the operating of actual mortars.

A training device for a mortar with the dimensions of a mortar is known from the document U.S. Pat. No. 6,059,753 PATEL, with which mortar training ammunition is used which comprise first electronic means which make possible a data transfer of the munition data selected for a round of mortar training ammunition to a computer. Second electronic means is arranged in the base plate of the training device for a mortar which make possible a detection and transmission of the firing tube alignment to the computer. Moreover, third electronic means is arranged on the base plate which can be brought in engagement with the first electronic means for data transfer.

The selectable munition data contains the munition type, the ignition setting, the number of charges and the ignition type. In order to determine the number of charges the rounds of mortar training ammunition have one or more sensors which make possible a determination of the number of charges positioned on the mortar training ammunition at the loading positioning means provided to this end.

The data transfer from the first electronic means attached to the mortar training ammunition to the third electronic means in the base plate takes place via electrical contacts arranged on the back end of the mortar training ammunition and which establish an electrical contact with the contact plate arranged on the back end of the firing tube when the mortar training ammunition falling down in the firing tube reaches the back end of the firing tube.

This known training device for a mortar has the disadvantage that the mortar training ammunition must be removed by hand from the firing tube.

The document EP 0 952 422 LAZECKI relates to a training device for a mortar with an evaluation unit which determines the geographical position of the training device for a mortar, the alignment of the firing tube and munition data and transmits them to a computer wirelessly from a transmission unit attached on the training device for a mortar.

A firing control is attached to the rounds of mortar training ammunition which recognizes the ignition type (striking-, delay-or timed ignition, etc.), the munition type and the number of additional charges. This munition data is protected by the firing control built into the mortar training ammunition and comprising a microcontroller and transmitted by an optical transmitter arranged on the back end of the mortar training ammunition to an optical receiver arranged on the bottom of the firing tube.

This known training device for a mortar can comprise more sensors, e.g., a brightness sensor which recognizes a "shot" over the darkness in the firing tube in conjunction with the inclination sensor, or an acceleration sensor which recognizes the "shot" by the impact of the mortar training ammunition on the bottom of the firing tube. Furthermore, sensors, e.g. switches, optical, inductive or capacitive sensors built into the mortar training ammunition can be used alone or in combination in order to detect whether a round of mortar training ammunition is present in the firing tube.

The firing tube comprises a discharge opening and guide sheets arranged in the area of this discharge opening in the firing tube which sheets conduct the mortar training ammunition out of the tube even when the firing tube is aligned almost vertically. This results in the disadvantage that the mortar training ammunition falls out of the discharge opening onto the ground so that the operating team is significantly disturbed by mortar training ammunition falling out, in particular in the case of a rapid firing frequency and in particular must perform false training actions due to the removal of the mortar training ammunition falling out.

The document WO 2013/025103 shows a training device for a mortar which comprises a device for removing a round of mortar training ammunition that fell out through the firing tube, wherein the removed mortar training ammunition is collected in a rotatable collection container arranged under the base plate. The device for removing the mortar training ammunition is constructed as a closable opening on the rear end of the firing tube which is in alignment with a perforation in the base plate so that mortar training ammunition can fall through the closable opening at the rear end of the firing tube and through the perforation in the base plate into the collection container. This known training device for a mortar has the disadvantage of the voluminous collection container for the "used" rounds of mortar training ammunition that is arranged under the baseplate. The collection chamber must be arranged in a dug out hollow space, wherein a support device carrying the training device for the mortar must be arranged in the hollow space underneath the base plate.

The invention has the purpose of creating help here. The invention is based on the problem of making available a training device for a mortar which can be readily transported and used even in terrain without special construction measures.

BRIEF SUMMARY OF THE INVENTION

The invention solves the problem posed with a training device for a mortar that comprises:

- a firing tube with a front, open end, a rear end, a tube wall, and a removal opening for removing mortar training ammunition from the firing tube;
- a base plate to which the rear end of the firing tube is pivotably connected; and
- a support with an aiming and alignment device;
- wherein the firing tube is movably connected to the support via the aiming and alignment device, and wherein the training device further comprises a transport device arranged on the rear end of the firing tube, by means of which mortar training ammunition is automatically transported away from the firing tube through the removal opening. Also disclosed is mortar training ammunition for use with such a training device for a mortar comprising:
- one or more batteries or accumulators;
- a microcontroller with a data storage for storing the type of the mortar training ammunition;

a first sensor for determining the ignition type and ignition setting;

at least one second sensor for determining the number of additional charges;

a transmitter for a wireless data transfer, and an on/off switch for turning at least the transmitter on and off.

The advantages achieved by the invention can be seen substantially in the fact that by virtue of the training device for a mortar:

A rapid setup of the training device for a mortar can be achieved even on the ground;

The setting up of the training device for a mortar can take place with the same manipulations as when setting up a mortar;

Shots with a rapid firing frequency under the performance of realistic actions are possible; and A realistic manipulation of the munition and of the loading process can be practiced.

Other advantageous embodiments of the invention can be commented on as follows:

In a special embodiment the removal opening penetrates the tube wall in the area of the rear end of the firing tube. This can achieve the advantage that the mortar training ammunition can be transported away laterally from the firing tube and therefore can be reused by the operating team for further "shots" without complicated manipulation.

In another embodiment the transport device comprises several cams for an engagement into a round of mortar training ammunition so that several rounds of mortar training ammunition can be successively removed through the removal opening out of the firing tube by the transport device. This embodiment has the advantage that the practicing of several successive shots becomes possible with a high shot frequency.

In another embodiment the firing tube has a longitudinal tube axis and the cams for receiving a round of mortar training ammunition falling down through the firing tube can be positioned coaxially to the longitudinal axis of the tube. The cams are preferably constructed for an engagement into a round of mortar training ammunition that is coaxial to or parallel to the longitudinal axis of the tube.

In yet another embodiment the removal opening is constructed as a cutout of the tube wall which extends from the rear end of the firing tube parallel to the longitudinal axis of the tube. This can bring it about that the transport device can be arranged outside of the rear end of the firing tube so that the rounds of mortar training ammunition can be transported away out of the firing tube in a translative manner transversely to the longitudinal axis of the tube.

In another embodiment the transport device is constructed as a carousel, wherein the cams are preferably arranged in a circle with the same intervals to each other. As a result of the construction of the transport device as a carousel the base surface of the transport device can be kept small. The intervals between the cams are preferably dimensioned for receiving one round of mortar training ammunition on each cam.

In another embodiment the carousel comprises an axis of rotation parallel to the longitudinal tube axis of the firing tube.

In another embodiment the transport device comprises a rotary plate that overlaps the firing tube on the rear end and has an axis of rotation parallel to the longitudinal axis of the tube. The axis of rotation of the rotary plate preferably has a distance to the longitudinal axis of the tube that corresponds to the radius of the circle on which the cams are arranged.

In yet another embodiment the transport device has at least five cams, preferably between five and eight cams.

In another embodiment the cams are constructed as pins which extend coaxially or parallel to the longitudinal tube axis of the firing tube and are constructed for being received in an open hollow space on a lower end of a round of mortar training ammunition. This can achieve the advantage that the rounds of mortar training ammunition are held by the cams and cannot fall down from the transport device when it executes rapid movements for removing the rounds of mortar training ammunition.

In another embodiment the firing tube comprises a second tube wall cutout for a passage of the cams which is opposite the removal opening, wherein the second tube wall cutout extends from the rear end of the firing tube parallel to a longitudinal axis of the tube.

In yet another embodiment the pins comprise spring caps which deflect upon the striking of a round of mortar training ammunition onto the transport device and establish an electrical contact. This embodiment makes the advantage possible that after the establishing of the electrical contact the transport device (carousel) executes a transport step so that the next cam is positioned in the firing tube.

In another embodiment the training device for a mortar comprises at least a first and a second sensor, wherein the first sensor detects the dropping down of a round of mortar training ammunition in the firing tube and the second sensor detects munition data of mortar training ammunition. The first sensor is preferably arranged on the outside of the firing tube and the tube wall comprises a hole in the area of the first sensor. The first sensor can be constructed as an optical sensor or as an inductive or capacitive sensor.

In another embodiment the second sensor is arranged on the outside of the firing tube and constructed as a receiver for a wireless data reception, preferably for a Bluetooth connection.

In another embodiment the munition data from mortar training ammunition specifies additional charge, munition type and/or ignition type and ignition setting.

In yet another embodiment the training device for a mortar additionally comprises a warning device that emits a warning signal, preferably an optical warning signal when all cams of the transport device are occupied by a round of mortar training ammunition.

In another embodiment the training device for a mortar additionally comprises a communication box to which data is transmitted concerning the alignment of the firing tube and the data detected by the first and second sensors and which makes possible a further transmitting of the data to a computer.

In another embodiment the communication box is arranged on the rear end of the firing tube and preferably adjacent to the transport device.

In another embodiment the training device for a mortar comprises at least a first and a second sensor, wherein the first sensor detects the dropping down of a round of mortar training ammunition in the firing tube and the second sensor detects munition data of mortar training ammunition, and wherein the first and the second sensors are arranged on the outside of the tube wall of the firing tube.

A special embodiment of a round of mortar training ammunition in accordance with the invention for the training device for a mortar in accordance with the invention comprises: a) one or more batteries or accumulators; b) a microcontroller with a data storage for storing the type of mortar training ammunition (munition type); c) a first sensor for determining the ignition type and ignition setting; d) at least one second sensor for determining the number of additional charges; e) a transmitter for a wireless transmission of data, and f) an on/off switch for turning at least the transmitter on and off. This embodiment of a round of mortar training ammunition makes the advantage possible that the mortar training ammunition (munition) to be used during a training can be turned on at the beginning of the training (scenario) and the user can use whichever of the mortar training ammunition he wants to. The turning on the electronic system by an inclination sensor, which is known from the prior art, can result in the case of a flat firing to a "non"-release of the electronic system of the mortar training ammunition (munition). The on/off switch can ensure that the data of the mortar training ammunition is detected by the computer.

In another embodiment of the mortar training ammunition the data determined by the first and second sensors is transmitted to the microcontroller and all data registered in the microcontroller is transmitted from the microcontroller via the transmitter to the computer.

In another embodiment of the mortar training ammunition the round of mortar training ammunition comprises a microeletromechanical system (MEMs tracker), preferably a 3D acceleration measuring device connected to the transmitter. This can achieve the advantage that the MEMs tracker "motion detector" can determine whether and how the mortar training ammunition is moved so that the manipulations of the rounds of mortar training ammunition, in particular their movement paths can be recorded by the computer. This can be graphically illustrated in the training system for a mortar.

In another embodiment of the round of mortar training ammunition the wireless data transmission is preferably a Bluetooth connection.

In another embodiment of the round of mortar training ammunition the round of mortar training ammunition comprises a lamp which emits light when the on/off switch is activated. This embodiment offers the advantages that the battery state of the mortar training ammunition (munition) can be continuously displayed by the lamp, as well as the fact that the battery of the mortar training ammunition (munition) must be charged. Furthermore, the light signal on the mortar training ammunition (munition) additionally ensures for the operator that the mortar training ammunition (munition) has built up the communication to the master module and to the training system for mortars (e.g., blue, permanently illuminating light). For example, permanent blue light means that the mortar training ammunition (munition) "is sharp". If the communication should be defective and therefore not established, the light on the mortar training ammunition (munition) blinks.

BRIEF DESCRIPTION OF THE DRAWINGS

The invention and further developments of the invention are shown in more detail in the following using the partially schematic representations of an exemplary embodiment.

In the drawings.

DETAILED DESCRIPTION OF EMBODIMENTS OF THE INVENTION

Figure 1:
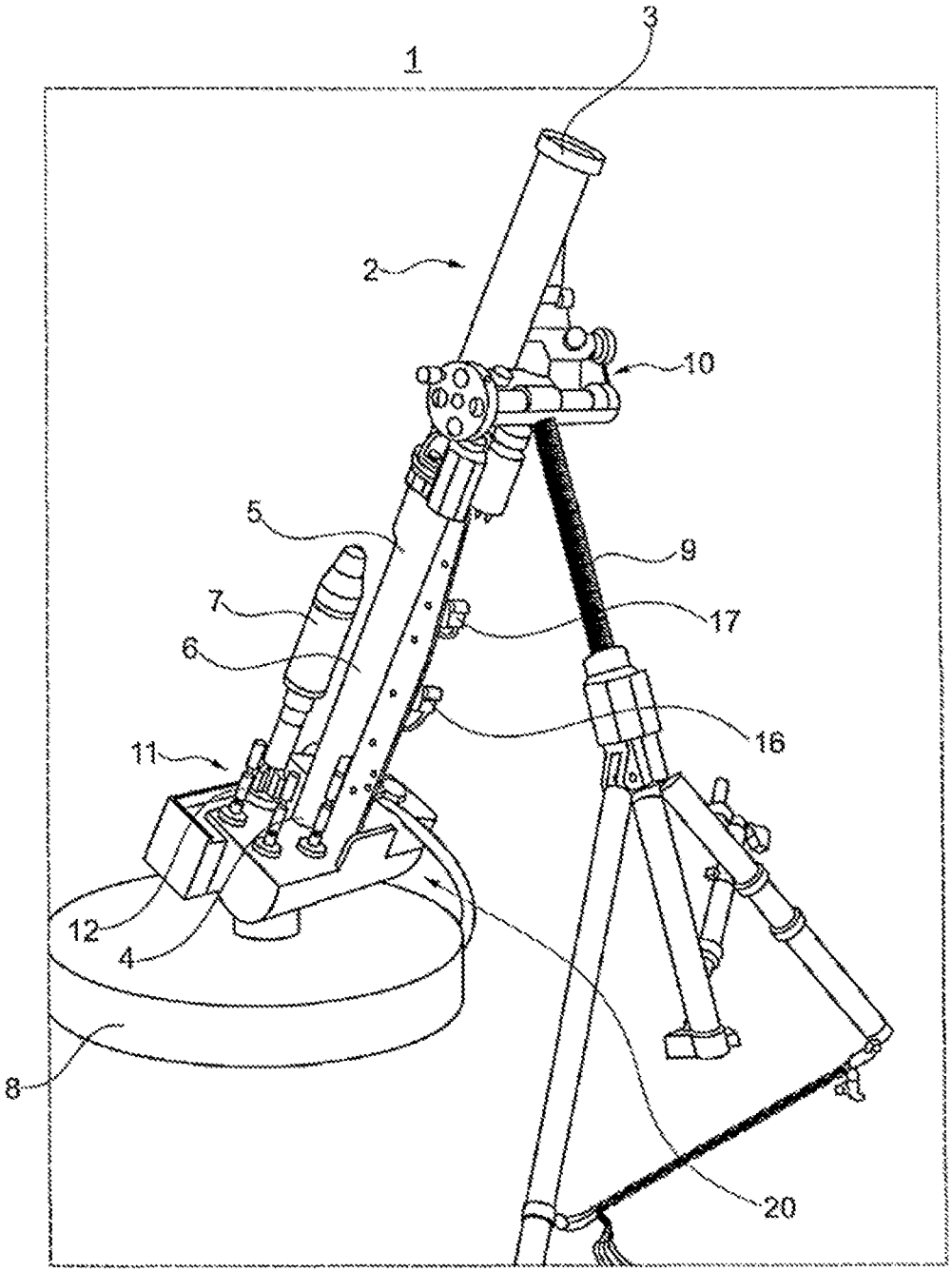
FIG. 1 shows a perspective view of an embodiment of the training device for a mortar in accordance with the invention.

The embodiment of the training device for a mortar 1 of the invention shown in the FIGS. 1-3, 6 and 7 substantially comprises a firing tube 2 with a front, open end 3, a rear open end 4 and a tube wall 5, a base plate 8 to which the rear end 4 of the firing tube 2 is pivotably connected, a support 9 with an aiming and alignment device 10 and a transport device 11 arranged on the rear end 4 of the firing tube 2 with which mortar training ammunition 7 can be automatically transported away through a removal opening 6 out of the firing tube 2. The support 9 is designed in this embodiment as a height-adjustable two-legged support but could alternatively also be constructed as a three-legged support. The firing tube 2 is movably connected to the support 9 at a front area via the aiming and alignment device 10. The transport device 2 comprises several cams 12 for an engagement into a round of mortar training ammunition 7 so that several rounds of mortar training ammunition 7 can be successively removed through the removal opening 6 out of the firing tube 2 by the transport device 11.

Figure 5:
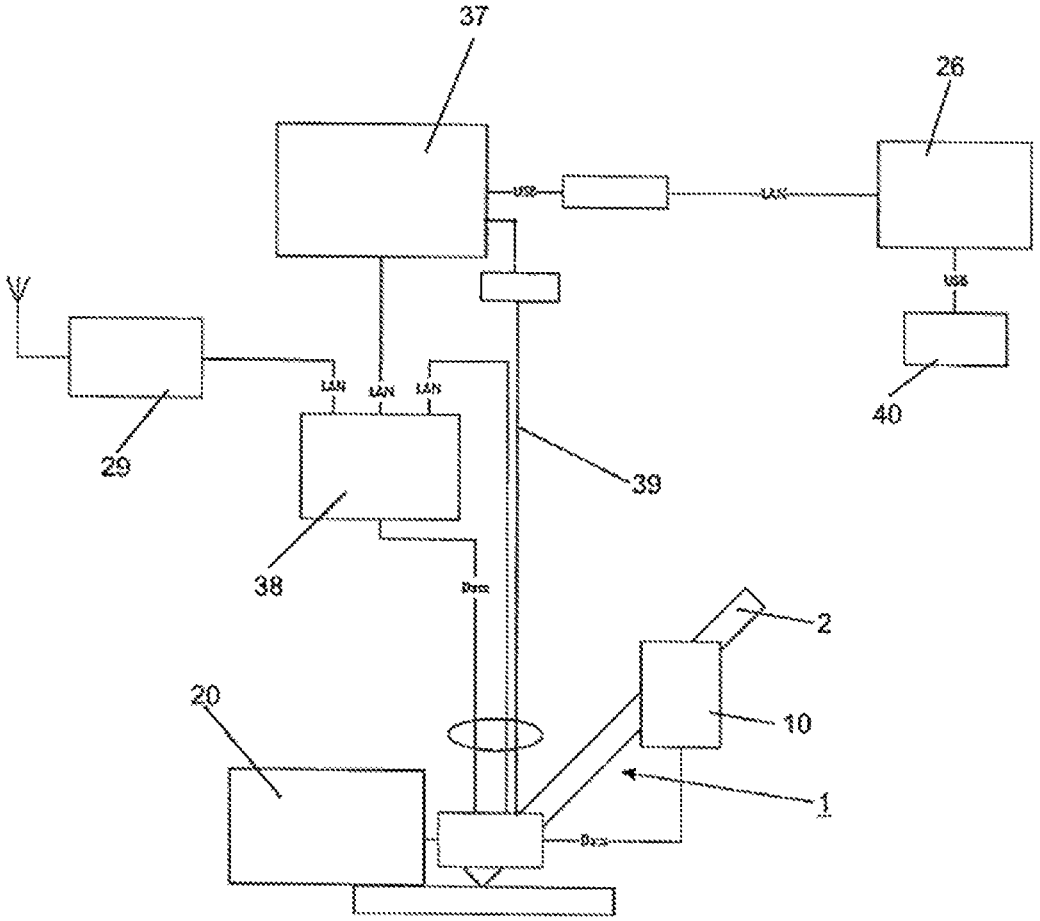
FIG. 5 shows a schematic view of an embodiment of a training system for a mortar.

The training device for a mortar 1 additionally comprises a communication box 20 to which data is transmitted concerning the alignment of the firing tube 2 and data detected by the sensors 16, 17, 28 attached to the firing tube 2 is transmitted and which makes possible a further transmitting of this data to a computer 26 (FIG. 5). The communication box 20 is arranged, for example, on the rear end 4 of the firing tube 2 and adjacent to the transport device 2. In particular, munition data of the round of mortar training ammunition 7 falling down in the firing tube 2 such as additional charge, munition type, ignition type and ignition setting is transmitted as described in the following to the communication box 20.

The removal opening 6 penetrates the tube wall 5 in the area of the rear end 4 of the firing tube 2 so that a round of mortar training ammunition 7 can be transported away laterally out of the firing tube 2, i.e., translatively obliquely to the longitudinal axis of the tube out of the firing tube 2. As is particularly evident in FIG. 2, the removal opening 6 is constructed as a tube wall cutout which extends parallel to the longitudinal tube axis of the firing tube 2 to the rear end 4 of the firing tube 2 so that the firing tube 2 has the shape of a hollow cylindrical section in the rear area.

The transport device 11 is constructed as a carousel with a rotary plate 27 (FIG. 2), wherein the cams 12 are arranged in a circle with the same intervals to each other. The carousel overlaps the firing tube 2 on the rear end 4 and has an axis of rotation parallel to the longitudinal axis of the tube, wherein the axis of rotation of the carousel has a distance to the longitudinal tube axis that corresponds to the radius of the circle on which the cams 12 are arranged. The transport device 11 in the present embodiment comprises five cams 12, wherein transport devices 11 with eight cams 12 are also possible.

The cams 12 are constructed as pins 13 arranged vertically on the rotary plate 27 and are therefore arranged parallel to the axis of rotation of the rotary plate 27. The rotary plate 27 is driven by a stepping motor, for example intermittently by an electromotor, wherein a pin 13 is always arranged coaxially to the longitudinal tube axis of the firing tube 2 so that a round of mortar training ammunition 7 falling down through the firing tube 2 comes into engagement with its hollow space open on its lower end with this pin 13. The round of mortar training ammunition 7 is therefore held by this pin 13 and cannot fall down from the transport device 11, e.g. when the rotary plate 27 executes rapid movements for the removal of the rounds of mortar training ammunition 7 from the firing tube 2. The other pins 13 are arranged parallel to the longitudinal tube axis on the rotary plate 27, wherein the intervals of the pins 13 are dimensioned in such a manner that a round of mortar training ammunition 7 can be positioned on each pin 13. Upon each rotary movement of the rotary plate 27 brought about by the stepping motor the next pin 13 is positioned coaxially to the longitudinal tube axis of the firing tube 2 until all pins 13 of the transport device 11 are occupied by a round of mortar training ammunition 7.

In order to guide the pins 13 not occupied by a round of mortar training ammunition 7 through the firing tube 2, the latter comprises a second tube wall cutout 15 (FIG. 2), which is designed for a passage of the pins 13 and located opposite the removal opening 6 and extends from the rear end 4 of the firing tube 2 parallel to the longitudinal tube axis of the firing tube 2. Furthermore, the pins 13 comprise spring caps 14 arranged on the ends of their free ends which deflect upon the striking of a round of mortar training ammunition 7 onto the transport device 11 and establish an electrical contact. After the establishing of the electrical contact the transport device 11 executes a transport step so that the next cam 13 is positioned in the firing tube 2.

Figure 6:
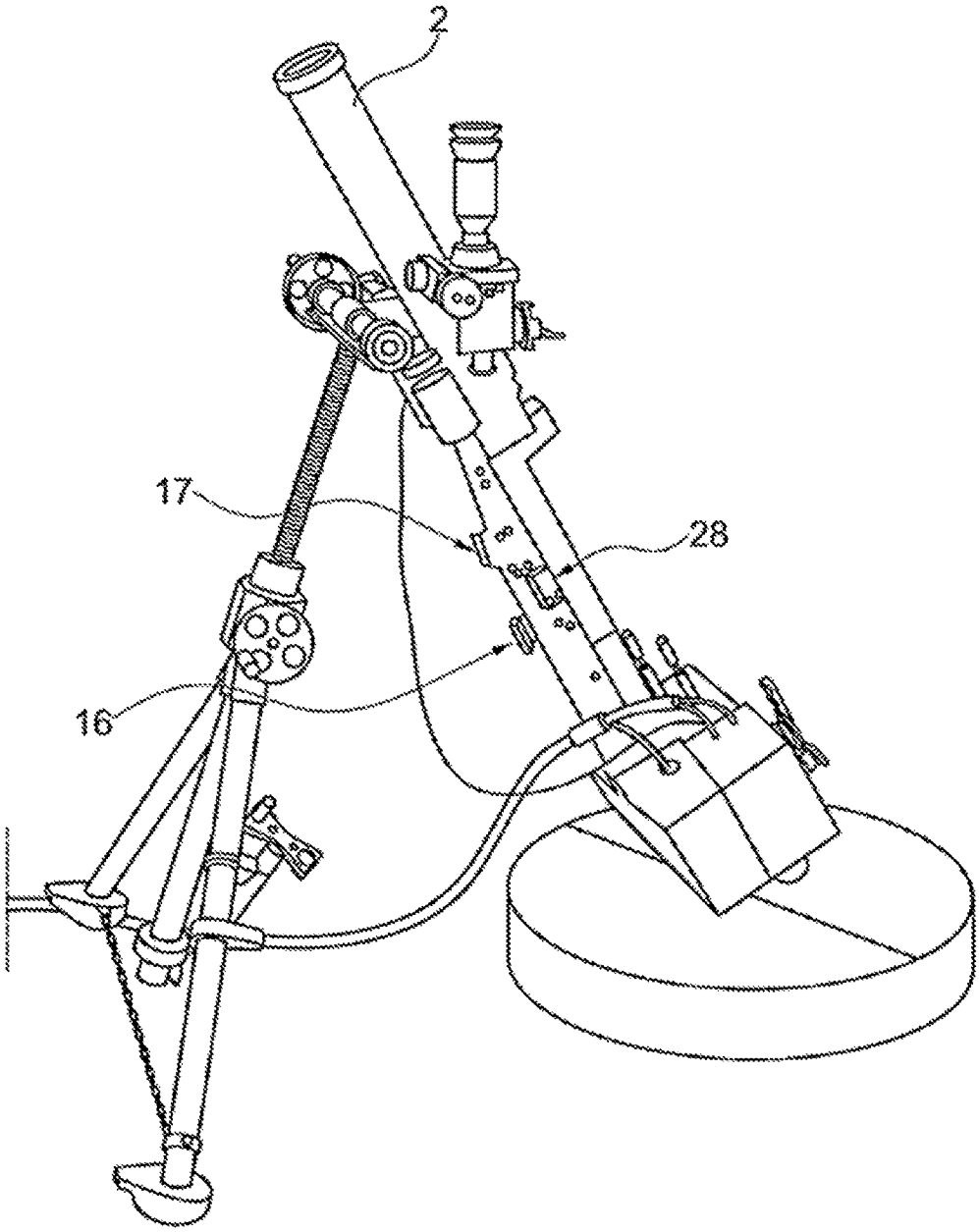
FIG. 6 shows a side view of the embodiment of the training device for a mortar in accordance with the invention shown in FIG. 1.

As the FIGS. 1-3, 6 and 7 show, the training device for a mortar 1 of the invention comprises in an exemplary and non-limiting manner a first, second and third sensor 16, 17, 28 (FIG. 6). Likewise, the arrangement of these sensors 16, 17, 28 on the firing tube 2 is shown in an exemplary and non-limiting manner in the FIGS. 1-3. The first sensor 16 detects a falling down of a round of mortar training ammunition 7 in the firing tube 2 and initiates with it the data transfer between the mortar training ammunition 7 and the second sensor 17. The first sensor 16 is constructed in an exemplary and non-limiting manner as an optical sensor, e.g. as a pure movement indicator. The munition data (as described in the following) of the falling down or rounds of mortar training ammunition 7 detected by the first sensor 16 is detected by the second and the third sensors 17, 28. Alternatively the training device for a mortar 1 can also comprise four sensors, in addition to first sensor that detects the falling down of a round of mortar training ammunition and initiates the data transfer between the round of mortar training ammunition 7 falling down and the communication box 20, a sensor designed for detecting the type of the mortar training ammunition, the number of additional charges 23 (FIG. 4) and the ignition type including the ignition setting.

Figure 2:
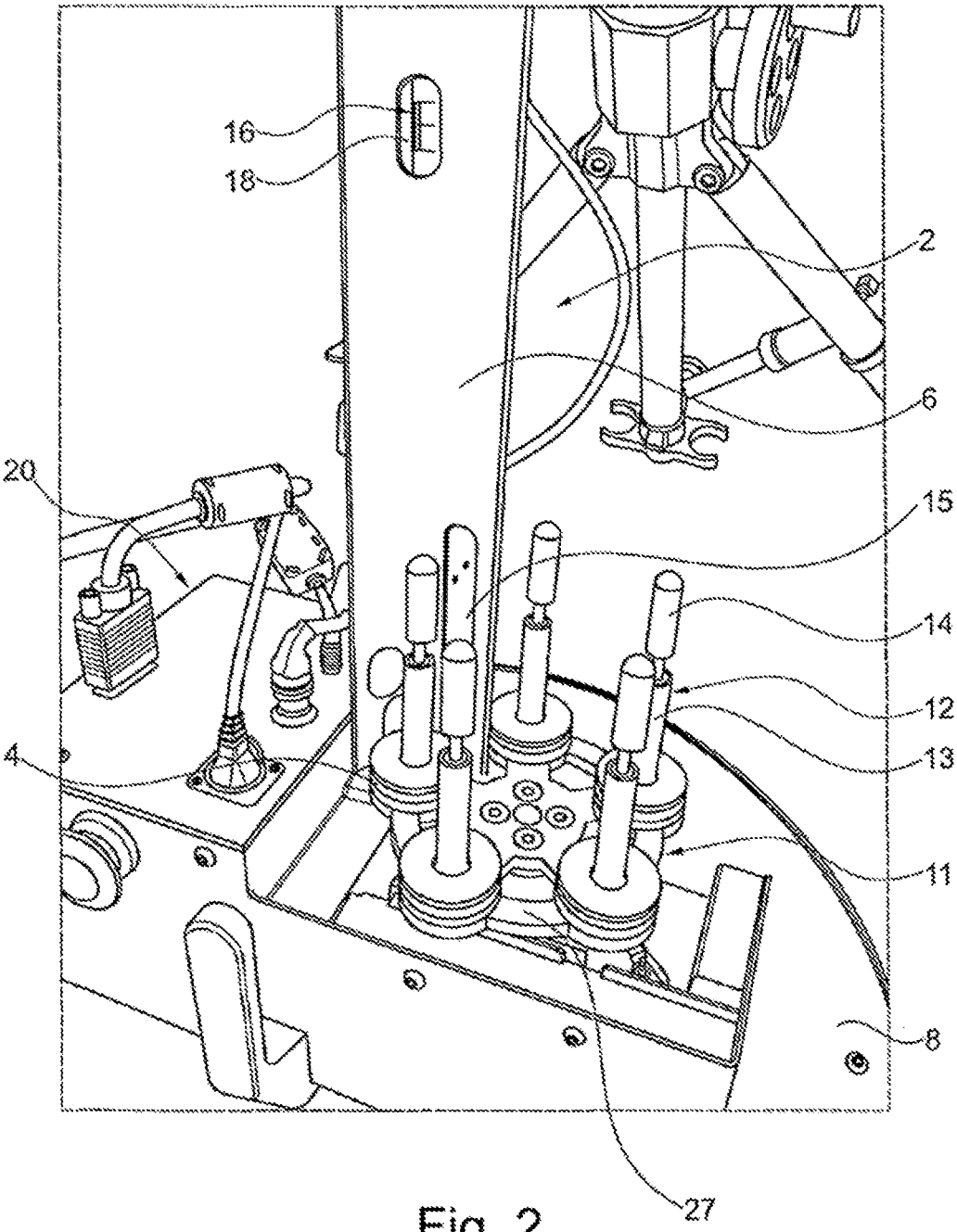
FIG. 2 shows an enlarged view of the rear end of the firing tube and of the transport device of the embodiment of the training device for a mortar of the invention shown in FIG. 1.
Figure 3:
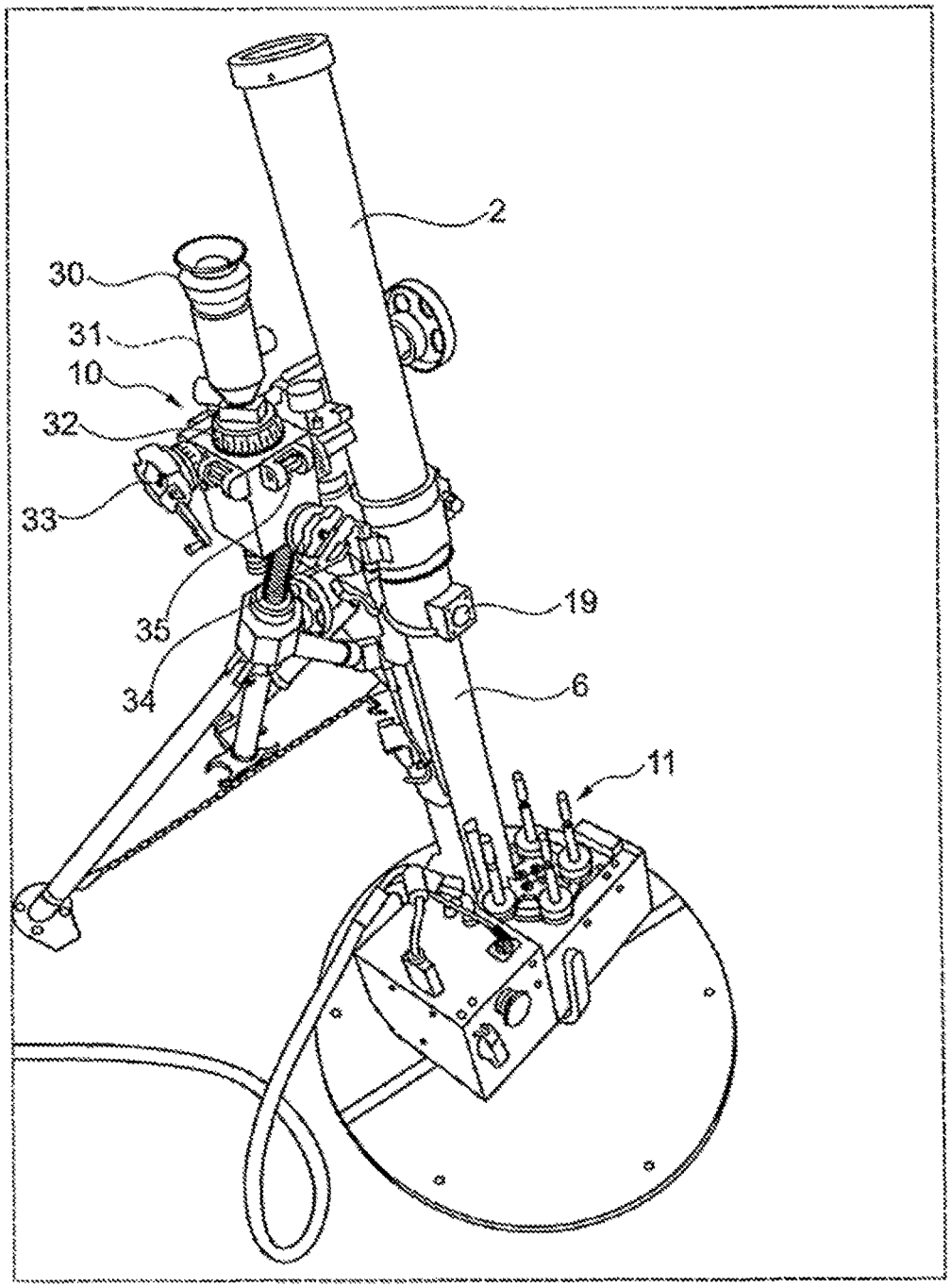
FIG. 3 shows a perspective view of the embodiment of the training device for a mortar in accordance with the invention shown in FIG. 1.

In addition, the training device for a mortar 1 shown in the FIGS. 1-3, 6 and 7 comprises a warning device 19 (FIGS. 3 and 7) that emits an optical warning signal by way of example but in a non-limiting manner when all cams 12 of the transport device 11 are occupied by a round of mortar training ammunition 7. The first, second and third sensors 16, 17, 28 are arranged by way of example on the outside of the firing tube 2, wherein the tube wall 5 has a hole 18 in the area of the first sensor 16 (FIG. 2). The second and third sensors 17, 28 are also arranged on the outside of the firing tube 2 and constructed as a receiver for a wireless data reception, preferably for a Bluetooth connection.

The mortar training ammunition 7 used in a training have a permanent contact with the training system for a mortar via the master module 29 (main computer) (FIG. 5). Several types of mortar training ammunition (munition types) with different configurations can be turned on and communicate with the master module 29. The second and the third sensors 17, 28 detect during the falling down of the mortar training ammunition 7 which of the "turned on" mortar training ammunition 7 fell down the firing tube 2 and in which configuration. The data transmission containing the data concerning the type of mortar training ammunition (munition type) used is initiated by the first sensor 16 (optical sensor).

The aiming and alignment device 10 (FIG. 3) substantially comprises an ocular 30 with a built-in video display 31 which makes possible a view of the scenario landscape, an azimuth scale 32 for a rough adjustment, an azimuth fine adjustment 33 with a scale and adjustment screw, a fine elevation adjustment 34 with scale and adjustment screw and levels 35 for an alignment of the transverse inclination and elevation of the aiming and alignment device 10. In addition, the aiming and alignment device 10 can comprise position detection sensors or a GPS system for determining the position of the training device for a mortar 1.

Figure 4:
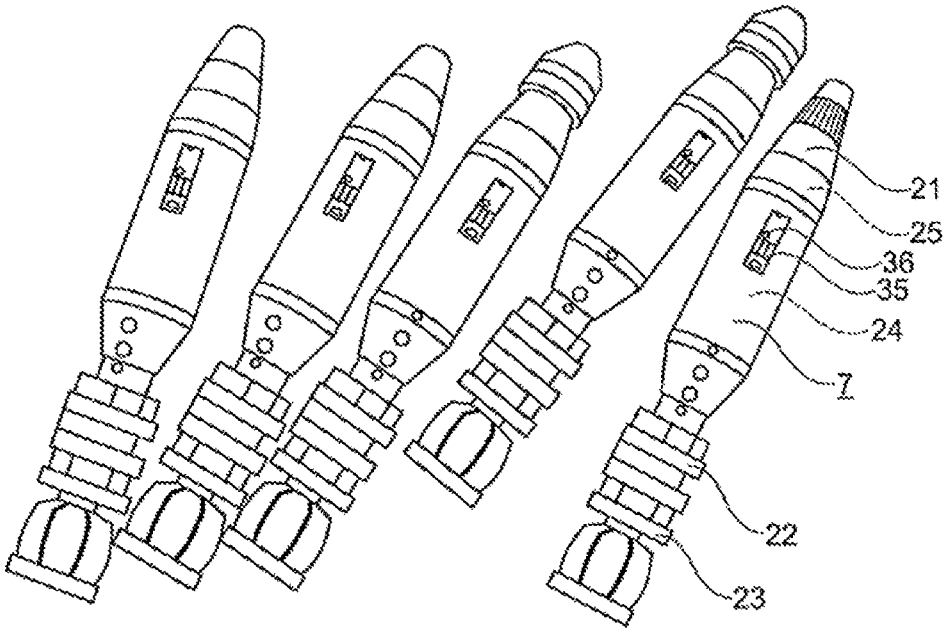
FIG. 4 shows a view of different embodiments of the round of mortar training ammunition in accordance with the invention.
Figure 7:
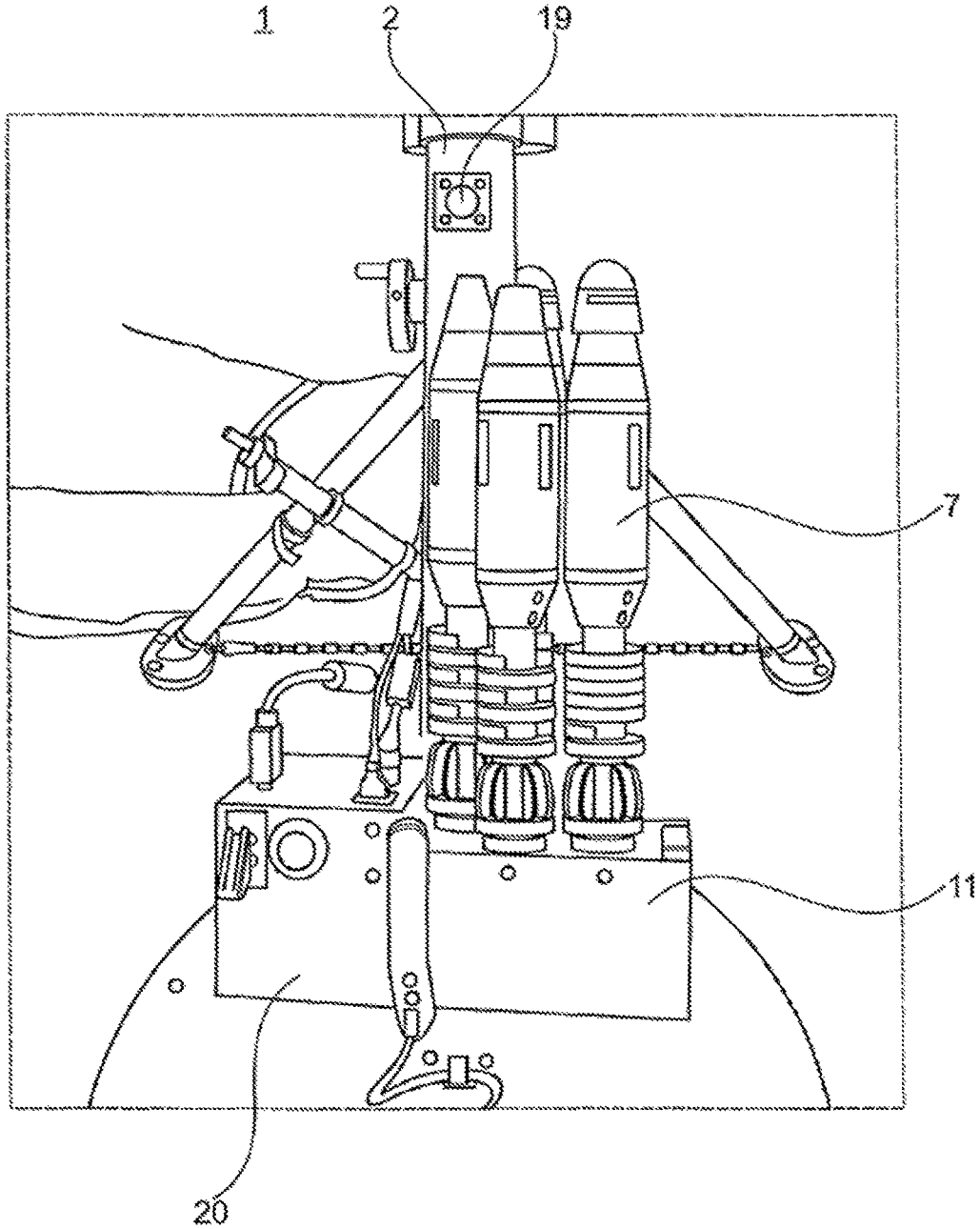
FIG. 7 shows an enlarged view of the rear end of the firing tube and of the transport device with several rounds of mortar training ammunition of the embodiment of the training device for a mortar of the invention shown in FIG. 1.

FIGS. 1, 4 and 7 show different embodiments of mortar training ammunition 7 of the invention. The mortar training ammunition 7 in accordance with the invention corresponds in its size, weight distribution (balance) and its weight to a real munition and substantially comprises a munition body and, arranged in the munition body, one or more batteries or accumulators, an on/off switch 35 for turning on and off at least the transmitter 25, a microcontroller 24 with a data storage for storing the type of mortar training ammunition (munition type), a first sensor 21 for determining the ignition type and ignition setting, at least one second sensor 22 for determining the number of additional charges 23 and a transmitter 25 for a wireless data transfer. When the on/off switch 35 is activated, the data of the mortar training ammunition 7 is transmitted by the transmitter 25 and detected by the computer 26. The data determined by the first and second sensors 21, 22 is transmitted to the microcontroller 24 and the data registered in the microcontroller 24 is transmitted from the microcontroller 24 via the transmitter 25 to the computer 26. Furthermore, the mortar training ammunition 7 comprises a microeletromechanical system (MEMs tracker), preferably a 3D acceleration measuring device connected to the transmitter 25 in such a manner that the movement paths during the manipulation of the mortar training ammunition 7 can be detected by the computer 26 and recorded. The wireless data transmission is preferably a Bluetooth connection. The mortar training ammunition 7 is additionally equipped with a lamp 36 that emits light when the on/off switch 35 is activated. The battery state of the mortar training ammunition 7 (munition) is continuously displayed by this lamp 36, as well as the fact that the battery of the mortar training ammunition 7 (munition) must be charged. The light signal on the mortar training ammunition 7 (munition) additionally ensures for the operator that the mortar training ammunition 7 (munition) has built up the communication to the master module 29 and to the training system for mortars (e.g., blue, permanently illuminating light). For example, permanent blue light means that the mortar training ammunition 7 (munition) "is sharp". If the communication should be defective and therefore not established, the lamp 36 on the mortar training ammunition 7 (munition) blinks.

FIG. 5 schematically shows an embodiment of a training system for a mortar which can be used together with the training device for a mortar 1 and the mortar training ammunition 7 of the invention as a simulation system for a training the operation of real mortars. Standard auxiliary software can be used for the simulation and a training of all participating parties.

This data detected by sensors 16, 17, 28 on the firing tube 2 of the training device for a mortar 1, the data determined by the aiming and alignment device 10 and the data transmitted from the mortar training ammunition 7 is transmitted to the communication box 20 on the training device for a mortar 1 and forwarded from there via an interface box 38 to the master module 29, a second computer 37 for the team operating the mortar and to the computer 26 of the exchange (instructor). In addition, a joystick 40 of the forward observer is connected to the computer 26 of the exchange which makes it possible for the forward observer to aim at a target so that the that the values for elevation and azimuth to be adjusted on the aiming and alignment device 10 can be forwarded to the team operating the mortar.

The data transmission from the communication box 20 to the interface box 38 and from the interface box 38 to the master module 29, the computer 26 of the exchange and the second computer 37 for the team operating the mortar takes place via cable connections. In addition, a VGA connection 39 (Video Graphics Array) is installed between the communication box 20 and the second computer 37 for the team operating the mortar which makes possible a translation of an image between graphic cards and display devices.

Although, as described above, different embodiments of the present invention are present, they are to be understood in such a manner that the various features can be used individually as well as in any desired combination.

Therefore, this invention is not limited simply to the above cited, especially preferred embodiments.

The invention claimed is:

1. A training device for a mortar, comprising:

a firing tube with a front, open end, a rear end, a tube wall, and a removal opening for removing a round of mortar training ammunition from the firing tube;

a base plate to which the rear end of the firing tube is pivotably connected; and a support with an aiming and alignment device;

wherein the firing tube is movably connected to the support via the aiming and alignment device, wherein the training device further comprises a transport device arranged on the rear end of the firing tube, by means of which rounds of mortar training ammunition are automatically transported away from the firing tube through the removal opening, wherein the removal opening is a tube wall cutout extending from the rear end of the firing tube parallel to a longitudinal tube axis, and wherein the transport device comprises a cam, which is configured to be received in an open hollow space on a lower end of a round of mortar training ammunition.

2. The training device for a mortar according to claim 1, wherein the transport device comprises several cams configured to engage with and successively remove a plurality of rounds of mortar training ammunition through the removal opening out of the firing tube.

3. The training device for a mortar according to claim 2, wherein each of the cams are configured to receive a round of mortar training ammunition falling down through the firing tube and are positioned coaxially to the longitudinal axis of the tube.

4. The training device for a mortar according to claim 2, wherein each of the cams are constructed for engaging into a round of mortar training ammunition coaxially to or parallel with the longitudinal tube axis.

5. The training device for a mortar according to claim 2, wherein the transport device is a carousel, and wherein the cams are arranged in a circle with similar intervals to each other.

6. The training device for a mortar according to claim 5, wherein the intervals between the cams are dimensioned for receiving one round of mortar training ammunition on each cam.

7. The training device for a mortar according to claim 5, wherein the carousel has an axis of rotation parallel to the longitudinal tube axis.

8. The training device for a mortar according to claim 5, wherein the transport device comprises a rotary plate that overlaps the firing tube on the rear end and has an axis of rotation parallel to the longitudinal tube axis.

9. The training device for a mortar according to claim 8, wherein the axis of rotation of the rotary plate has a distance to the longitudinal tube axis that corresponds to a radius of the circle.

10. The training device for a mortar according to claim 2, wherein the transport device comprises at least five cams.

11. The training device for a mortar according to claim 2, wherein the cams are constructed as pins which extend coaxially or parallel to the longitudinal tube axis, and wherein the pins are configured to be received in an open hollow space on a lower end of a round of mortar training ammunition.

12. The training device for a mortar according to claim 1, wherein the firing tube has a second tube wall cutout for a passage of the cams opposite the removal opening, and wherein the second tube wall cutout extends from the rear end of the firing tube parallel to the longitudinal tube axis.

13. The training device for a mortar according to claim 11, wherein the pins comprise spring caps which deflect upon the striking of a round of mortar training ammunition onto the transport device and establish an electrical contact.

14. The training device for a mortar according to claim 1, wherein the training device comprises at least a first and a second sensor, wherein the first sensor detects a dropping down of a round of mortar training ammunition in the firing tube and the second sensor detects munition data of mortar training ammunition.

15. The training device for a mortar according to claim 14, wherein the first sensor is arranged on an outside of the firing tube, and wherein the tube wall has a hole in an area of the first sensor.

16. The training device for a mortar according to claim 14, wherein the second sensor is arranged on the outside of the firing tube and is constructed as a receiver for wireless data reception.

17. The training device for a mortar according to claim 14, wherein the munition data from mortar training ammunition specifies additional charge, munition type and/or ignition type and ignition setting.

18. The training device for a mortar according to claim 2, wherein the training device further comprises a warning device that emits a warning signal when all cams of the transport device are occupied by a round of mortar training ammunition.

19. The training device for a mortar according to claim 14, wherein the training device further comprises a communication box for transmitting data concerning alignment of the firing tube and data detected by the first and second sensors to a computer (26).

20. The training device for a mortar according to claim 19, wherein the communication box is arranged on the rear end of the firing tube.

21. The training device for a mortar according to claim 1, wherein the training device comprises at least a first and a second sensor, wherein the first sensor detects a dropping down of a round of mortar training ammunition in the firing tube and the second sensor detects munition data of mortar training ammunition, and wherein the first and the second sensors are arranged on an outside of the tube wall of the firing tube.

22. A round of mortar training ammunition for a training device for a mortar according to claim 1, comprising:

one or more batteries or accumulators;

a microcontroller with a data storage for storing a type of the mortar training ammunition;

a first sensor for determining an ignition type and an ignition setting;

at least one second sensor for determining a number of additional charges;

a transmitter for a wireless data transfer; and an on/off switch for turning at least the transmitter on and off;

wherein a lower end of the round of mortar training ammunition comprises an open hollow space configured to receive and engage with a cam of a transport device of the training device for a mortar.

23. The round of mortar training ammunition according to claim 22, wherein the data determined by the first and second sensors is transmitted to the microcontroller and all data registered in the microcontroller is transmitted from the microcontroller via the transmitter to a computer.

24. The round of mortar training ammunition according to claim 22, wherein the round of mortar training ammunition comprises a microeletromechanical system (MEMs tracker), which is connected to the transmitter.

25. The round of mortar training ammunition according to claim 22, wherein the wireless data-transfer is a Bluetooth connection.

26. The round of mortar training ammunition according to claim 22, wherein the round of mortar training ammunition comprises a lamp that emits light when the on/off switch is activated.

* * * * *